US010487564B2

(12) United States Patent
Rust

(10) Patent No.: US 10,487,564 B2
(45) Date of Patent: Nov. 26, 2019

(54) DOOR ACTUATOR ADJUSTMENT FOR AUTONOMOUS VEHICLES

(71) Applicant: GM GLOBAL TECHNOLOGY OPERATIONS LLC, Detroit, MI (US)

(72) Inventor: Ian Rust, San Francisco, CA (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 244 days.

(21) Appl. No.: 15/585,898

(22) Filed: May 3, 2017

(65) Prior Publication Data

US 2017/0241184 A1 Aug. 24, 2017

(51) Int. Cl.
*E05F 15/73* (2015.01)
*E05F 15/40* (2015.01)

(52) U.S. Cl.
CPC ..... *E05F 15/73* (2015.01); *E05F 15/40* (2015.01)

(58) Field of Classification Search
CPC ..... E05F 15/40; E05F 15/73
USPC ..... 49/30, 31
See application file for complete search history.

(56) References Cited

U.S. PATENT DOCUMENTS

| | | | | |
|---|---|---|---|---|
| 8,091,280 | B2 * | 1/2012 | Hanzel | B60R 25/2054 296/146.4 |
| 9,217,272 | B2 * | 12/2015 | Phillips | E05D 15/54 |
| 2014/0133474 | A1 * | 5/2014 | Damnjanovic | H04W 52/30 370/336 |
| 2017/0249797 | A1 * | 8/2017 | Elie | G07F 17/0057 |
| 2018/0023334 | A1 * | 1/2018 | Kwak | E05F 15/76 49/31 |
| 2018/0038146 | A1 * | 2/2018 | Linden | E05B 81/20 |
| 2018/0044963 | A1 * | 2/2018 | Gomez Melchor | E05F 15/40 |

* cited by examiner

*Primary Examiner* — Chi Q Nguyen
(74) *Attorney, Agent, or Firm* — Lorenz & Kopf, LLP

(57) ABSTRACT

In one embodiment, a method for controlling an actuator for a door of an autonomous vehicle comprises obtaining data pertaining to a current ride of an autonomous vehicle during operation of the autonomous vehicle; identifying, via a processor using the data, whether one or more circumstances are present that would require an adjustment of a baseline instruction for an automatic opening of the door by the autonomous vehicle via the actuator based on instructions provided to the actuator by the processor; determining an adjustment of the baseline instruction when one or more of the circumstances are present; receiving a request to open the door; and, upon receiving the request: providing the baseline instruction for the actuator to open the door, when none of the circumstances are present; and providing an alternate instruction for the actuator, based on the adjustment, when one or more of the circumstances are present.

20 Claims, 6 Drawing Sheets

DOOR ACTUATOR ADJUSTMENT FOR AUTONOMOUS VEHICLES

TECHNICAL FIELD

The present disclosure generally relates to vehicles, and more particularly relates to systems and methods for adjusting door actuators for autonomous vehicles.

BACKGROUND

An autonomous vehicle is a vehicle that is capable of sensing its environment and navigating with little or no user input. It does so by using sensing devices such as radar, lidar, image sensors, and the like. Autonomous vehicles further use information from global positioning systems (GPS) technology, navigation systems, vehicle-to-vehicle communication, vehicle-to-infrastructure technology, and/or drive-by-wire systems to navigate the vehicle.

While autonomous vehicles offer many potential advantages over traditional vehicles, in certain circumstances it may be desirable for improved operation of door actuators for autonomous vehicles.

Accordingly, it is desirable to provide systems and methods for adjusting door actuators of autonomous vehicles.

SUMMARY

Systems and methods are provided for controlling door actuators for an autonomous vehicle. In one embodiment, a method for controlling an actuator for a door of an autonomous vehicle includes obtaining data pertaining to a current ride of an autonomous vehicle during operation of the autonomous vehicle; identifying, via a processor using the data, whether one or more circumstances are present that would require an adjustment of a baseline instruction for an automatic opening of the door by the autonomous vehicle via the actuator; determining an adjustment of the baseline instruction when one or more of the circumstances are present; receiving a request to open the door; and, upon receiving the request: providing the baseline instruction for the actuator to open the door, when none of the circumstances are present; and providing an alternate instruction for the actuator, based on the adjustment, when one or more of the circumstances are present.

The method further includes wherein the adjustment includes a change in a rate of speed in which the door is automatically opened by the autonomous vehicle upon receiving the request.

The method further includes wherein the adjustment includes a change in a distance to which the door is automatically opened by the autonomous vehicle upon receiving the request.

The method further includes wherein the obtaining of the data includes obtaining data as to a geographic location in which the autonomous vehicle is travelling; and the determining of the adjustment includes determining the adjustment of the baseline instruction based on the geographic location.

The method further includes wherein: the obtaining of the data includes obtaining data as to a geographic location in which the autonomous vehicle is travelling; and the determining of the adjustment includes determining the adjustment of the baseline instruction based on the geographic location.

The method further includes wherein: the obtaining of the data includes obtaining data as to a status of the current ride for the autonomous vehicle; and the determining of the adjustment includes determining the adjustment of the baseline instruction based on the status of the current ride.

The method further includes wherein: the obtaining of the data includes obtaining data as to one or more objects detected in proximity to the autonomous vehicle; and the determining of the adjustment includes determining the adjustment of the baseline instruction based on the one or more detected objects.

The method further includes wherein: the obtaining of the data includes obtaining data as to an accessibility characteristic of an occupant of the autonomous vehicle; and the determining of the adjustment includes determining the adjustment of the baseline instruction based on the accessibility characteristic of the occupant.

The method further includes wherein: the obtaining of the data includes obtaining data as to detected motion inside the autonomous vehicle; and the determining of the adjustment includes determining the adjustment of the baseline instruction based on the detected motion inside the autonomous vehicle.

In another embodiment, a system for controlling an actuator for a door of an autonomous vehicle includes a door actuator control module and a door actuator determination module. The door actuator control module is configured to at least facilitate obtaining data pertaining to a current ride of an autonomous vehicle during operation of the autonomous vehicle, and receiving a request to open the door. The door actuator determination module includes a processor, and is configured to at least facilitate: identifying whether one or more circumstances are present that would require an adjustment of a baseline instruction for an automatic opening of the door by the autonomous vehicle via the actuator based on instructions provided to the actuator by the processor; determining an adjustment of the baseline instruction when one or more of the circumstances are present; and, upon receiving the request: providing the baseline instruction for the actuator to open the door, when none of the circumstances are present; and providing an alternate instruction for the actuator, based on the adjustment, when one or more of the circumstances are present.

The system further includes wherein the adjustment includes a change in whether the door is automatically opened by the autonomous vehicle upon receiving the request.

The system further includes wherein the adjustment includes a change in a rate of speed in which the door is automatically opened by the autonomous vehicle upon receiving the request.

The system further includes wherein: the door actuator control module is configured to at least facilitate obtaining data as to a geographic location in which the autonomous vehicle is travelling; and the door actuator control module is configured to at least facilitate determining the adjustment of the baseline instruction based on the geographic location.

The system further includes wherein: the door actuator control module is configured to at least facilitate obtaining data as to a status of the current ride for the autonomous vehicle; and the door actuator determination module is configured to at least facilitate determining the adjustment of the baseline instruction based on the status of the current ride.

The system further includes wherein: the door actuator control module is configured to at least facilitate obtaining data as to one or more objects detected in proximity to the autonomous vehicle; and the door actuator determination module is configured to at least facilitate determining the adjustment of the baseline instruction based on the one or more detected objects.

The system further includes wherein: the door actuator control module is configured to at least facilitate obtaining data as to an accessibility characteristic of an occupant of the autonomous vehicle; and the door actuator determination module is configured to at least facilitate determining the adjustment of the baseline instruction based on the accessibility characteristic of the occupant.

The system further includes wherein: the door actuator control module is configured to at least facilitate obtaining data as to detected motion inside the autonomous vehicle; and the door actuator determination module is configured to at least facilitate determining the adjustment of the baseline instruction based on the detected motion inside the autonomous vehicle.

In a further embodiment, au autonomous vehicle includes a door, an actuator, one or more sensors, and a processor. The actuator is configured to open the door. The one or more sensors are configured to at least facilitate obtaining data pertaining to a current ride of the autonomous vehicle during operation of the autonomous vehicle. The processor configured to at least facilitate: identifying whether one or more circumstances are present that would require an adjustment of a baseline instruction for an automatic opening of the door by the autonomous vehicle via the actuator based on instructions provided to the actuator by the processor; determining the adjustment of the baseline instruction when one or more of the circumstances are present; receiving a request to open the door; and upon receiving the request: providing the baseline instruction for the actuator to open the door, when none of the circumstances are present; and providing an alternate instruction for the actuator, based on the adjustment, when one or more of the circumstances are present.

The autonomous vehicle further includes a memory configured to store the baseline instruction and the alternate instruction.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary, or the following detailed description. As used herein, the term "module" refers to any hardware, software, firmware, electronic control component, processing logic, and/or processor device, individually or in any combination, including without limitation: application specific integrated circuit (ASIC), a field-programmable gate-array (FPGA), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the systems described herein is merely exemplary embodiments of the present disclosure.

For the sake of brevity, conventional techniques related to signal processing, data transmission, signaling, control, machine learning, image analysis, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

Figure 1:
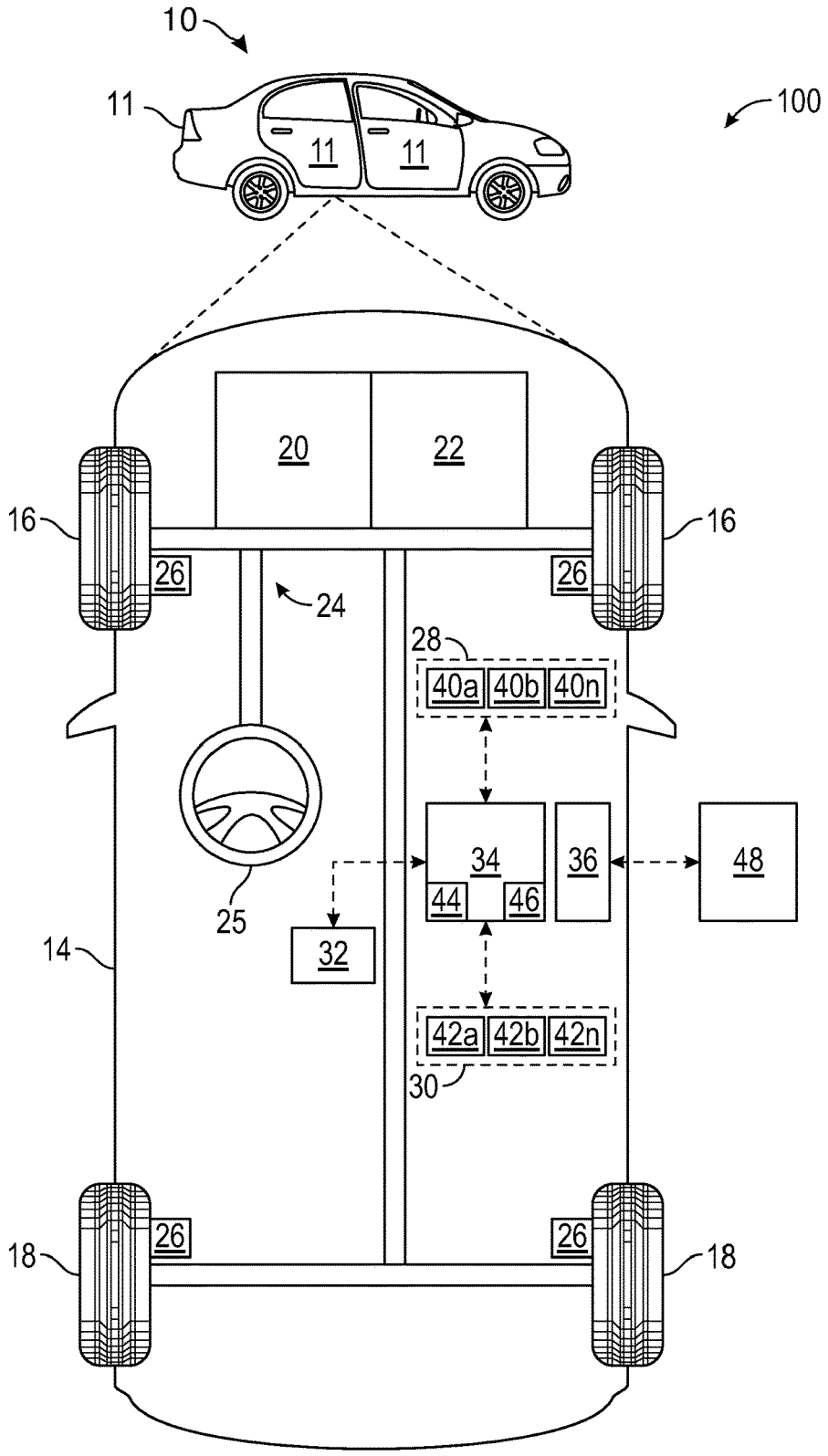
FIG. 1 is a functional block diagram illustrating an autonomous vehicle, in accordance with various embodiments.

With reference to FIG. 1, a door actuator control system 100 shown generally as 100 is associated with a vehicle 10 in accordance with various embodiments. In general, the door actuator control system (or simply "system") 100 controls operation of actuators (e.g., actuator devices 42*a*-42*n*, described further below) for opening one or more doors 11 of the vehicle 10.

As depicted in FIG. 1, the vehicle 10 generally includes a chassis 12, a body 14, front wheels 16, and rear wheels 18. The body 14 is arranged on the chassis 12 and substantially encloses components of the vehicle 10. The body 14 and the chassis 12 may jointly form a frame. The wheels 16-18 are each rotationally coupled to the chassis 12 near a respective corner of the body 14.

In various embodiments, the vehicle 10 is an autonomous vehicle and the door actuator control system 100, and/or components thereof, are incorporated into the autonomous vehicle 10 (hereinafter referred to as the autonomous vehicle 10). The autonomous vehicle 10 is, for example, a vehicle that is automatically controlled to carry passengers from one location to another. The vehicle 10 is depicted in the illustrated embodiment as a passenger car, but it should be appreciated that any other vehicle, including motorcycles, trucks, sport utility vehicles (SUVs), recreational vehicles (RVs), marine vessels, aircraft, and the like, can also be used.

In an exemplary embodiment, the autonomous vehicle 10 corresponds to a level four or level five automation system under the Society of Automotive Engineers (SAE) "J3016" standard taxonomy of automated driving levels. Using this terminology, a level four system indicates "high automation," referring to a driving mode in which the automated driving system performs all aspects of the dynamic driving task, even if a human driver does not respond appropriately to a request to intervene. A level five system, on the other hand, indicates "full automation," referring to a driving mode in which the automated driving system performs all aspects of the dynamic driving task under all roadway and environmental conditions that can be managed by a human driver. It will be appreciated, however, the embodiments in accordance with the present subject matter are not limited to any particular taxonomy or rubric of automation categories. Furthermore, systems in accordance with the present embodiment may be used in conjunction with any autonomous or other vehicle that utilizes a navigation system and/or other systems to provide route guidance and/or implementation.

As shown, the autonomous vehicle 10 generally includes a propulsion system 20, a transmission system 22, a steering system 24, a brake system 26, a sensor system 28, an actuator system 30, at least one data storage device 32, at least one controller 34, and a communication system 36. The propulsion system 20 may, in various embodiments, include an internal combustion engine, an electric machine such as a traction motor, and/or a fuel cell propulsion system. The transmission system 22 is configured to transmit power from the propulsion system 20 to the vehicle wheels 16 and 18 according to selectable speed ratios. According to various embodiments, the transmission system 22 may include a step-ratio automatic transmission, a continuously-variable transmission, or other appropriate transmission.

The brake system 26 is configured to provide braking torque to the vehicle wheels 16 and 18. Brake system 26 may, in various embodiments, include friction brakes, brake by wire, a regenerative braking system such as an electric machine, and/or other appropriate braking systems.

The steering system 24 influences a position of the vehicle wheels 16 and/or 18. While depicted as including a steering wheel 25 for illustrative purposes, in some embodiments contemplated within the scope of the present disclosure, the steering system 24 may not include a steering wheel.

The sensor system 28 includes one or more sensing devices 40*a*-40*n* that sense observable conditions of the exterior environment and/or the interior environment of the autonomous vehicle 10. The sensing devices 40*a*-40*n* might include, but are not limited to, radars, lidars, global positioning systems, optical cameras, thermal cameras, ultrasonic sensors, and/or other sensors. The actuator system 30 includes one or more actuator devices 42*a*-42*n* that control one or more vehicle features of the vehicle 10. In various embodiments, the actuator devices 42*a*-42*n* control opening and closing of the various doors 11 of the vehicle 10. In addition, in various embodiments, the actuator devices 42*a*-42*n* (also referred to as the actuators 42) control one or more other features such as, but not limited to, the propulsion system 20, the transmission system 22, the steering system 24, and the brake system 26. In various embodiments, autonomous vehicle 10 may also include interior and/or exterior vehicle features not illustrated in FIG. 1, such as a trunk, and cabin features such as air, music, lighting, touch-screen display components (such as those used in connection with navigation systems), and the like. As used herein, the terms "actuating device" and "actuator" are used synonymously.

The data storage device 32 stores data for use in automatically controlling the autonomous vehicle 10. In various embodiments, the data storage device 32 stores defined maps of the navigable environment. In various embodiments, the defined maps may be predefined by and obtained from a remote system (described in further detail with regard to FIG. 2). For example, the defined maps may be assembled by the remote system and communicated to the autonomous vehicle 10 (wirelessly and/or in a wired manner) and stored in the data storage device 32. Route information may also be stored within data device 32—i.e., a set of road segments (associated geographically with one or more of the defined maps) that together define a route that the user may take to travel from a start location (e.g., the user's current location) to a target location. Also in various embodiments, the data storage device 32 stores data pertaining to particular operators of the vehicle 10, baseline instructions for operation of an actuator for opening doors 11 of the vehicle 10, and/or other information pertaining to the opening of the doors 11. As will be appreciated, the data storage device 32 may be part of the controller 34, separate from the controller 34, or part of the controller 34 and part of a separate system.

The controller 34 includes at least one processor 44 and a computer-readable storage device or media 46. The processor 44 may be any custom-made or commercially available processor, a central processing unit (CPU), a graphics processing unit (GPU), an auxiliary processor among several processors associated with the controller 34, a semiconductor-based microprocessor (in the form of a microchip or chip set), any combination thereof, or generally any device for executing instructions. The computer readable storage device or media 46 may include volatile and non-volatile storage in read-only memory (ROM), random-access memory (RAM), and keep-alive memory (KAM), for example. KAM is a persistent or non-volatile memory that may be used to store various operating variables while the processor 44 is powered down. The computer-readable storage device or media 46 may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 34 in controlling the autonomous vehicle 10.

The instructions may include one or more separate programs, each of which comprises an ordered listing of executable instructions for implementing logical functions. The instructions, when executed by the processor 44, receive and process signals from the sensor system 28, perform logic, calculations, methods and/or algorithms for automatically controlling the components of the autonomous vehicle 10, and generate control signals that are transmitted to the actuator system 30 to automatically control the components of the autonomous vehicle 10 based on the logic, calculations, methods, and/or algorithms. Although only one controller 34 is shown in FIG. 1, embodiments of the autonomous vehicle 10 may include any number of controllers 34 that communicate over any suitable communication medium or a combination of communication mediums and that cooperate to process the sensor signals, perform logic, calculations, methods, and/or algorithms, and generate control signals to automatically control features of the autonomous vehicle 10. In one embodiment, as discussed in detail below, controller 34 is configured for use in controlling actuators (e.g., actuator devices 42*a*-42*n*, described further below) for doors 11 of the vehicle 10.

Figure 2:
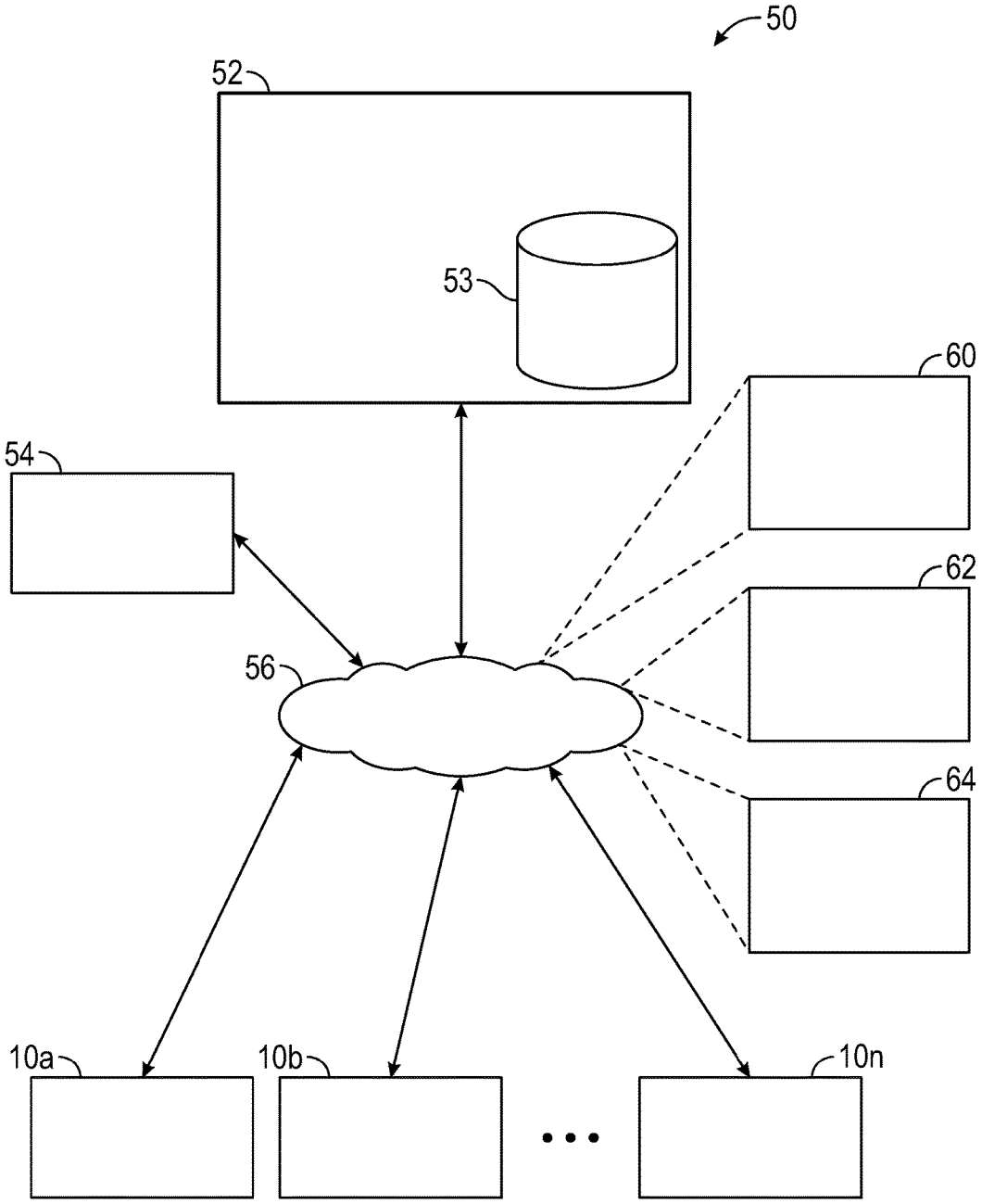
FIG. 2 is a functional block diagram illustrating a transportation system having one or more autonomous vehicles as shown in FIG. 1, in accordance with various embodiments.

The communication system 36 is configured to wirelessly communicate information to and from other entities 48, such as but not limited to, other vehicles ("V2V" communication), infrastructure ("V2I" communication), remote transportation systems, and/or user devices (described in more detail with regard to FIG. 2). In an exemplary embodiment, the communication system 36 is a wireless communication system configured to communicate via a wireless local area network (WLAN) using IEEE 802.11 standards or by using cellular data communication. However, additional or alternate communication methods, such as a dedicated short-range communications (DSRC) channel, are also considered within the scope of the present disclosure. DSRC channels refer to one-way or two-way short-range to medium-range wireless communication channels specifically designed for automotive use and a corresponding set of protocols and standards.

With reference now to FIG. 2, in various embodiments, the autonomous vehicle 10 described with regard to FIG. 1 may be suitable for use in the context of a taxi or shuttle system in a certain geographical area (e.g., a city, a school or business campus, a shopping center, an amusement park, an event center, or the like) or may simply be managed by a remote system. For example, the autonomous vehicle 10 may be associated with an autonomous vehicle based remote transportation system. FIG. 2 illustrates an exemplary embodiment of an operating environment shown generally at 50 that includes an autonomous vehicle based remote transportation system (or simply "remote transportation system") 52 that is associated with one or more autonomous vehicles 10*a*-10*n* as described with regard to FIG. 1. In various embodiments, the operating environment 50 (all or a part of which may correspond to entities 48 shown in FIG. 1) further includes one or more user devices 54 that communicate with the autonomous vehicle 10 and/or the remote transportation system 52 via a communication network 56.

The communication network 56 supports communication as needed between devices, systems, and components supported by the operating environment 50 (e.g., via tangible communication links and/or wireless communication links). For example, the communication network 56 may include a wireless carrier system 60 such as a cellular telephone system that includes a plurality of cell towers (not shown), one or more mobile switching centers (MSCs) (not shown), as well as any other networking components required to connect the wireless carrier system 60 with a land communications system. Each cell tower includes sending and receiving antennas and a base station, with the base stations from different cell towers being connected to the MSC either directly or via intermediary equipment such as a base station controller. The wireless carrier system 60 can implement any suitable communications technology, including for example, digital technologies such as CDMA (e.g., CDMA2000), LTE (e.g., 4G LTE or 5G LTE), GSM/GPRS, or other current or emerging wireless technologies. Other cell tower/base station/MSC arrangements are possible and could be used with the wireless carrier system 60. For example, the base station and cell tower could be co-located at the same site or they could be remotely located from one another, each base station could be responsible for a single cell tower or a single base station could service various cell towers, or various base stations could be coupled to a single MSC, to name but a few of the possible arrangements.

Apart from including the wireless carrier system 60, a second wireless carrier system in the form of a satellite communication system 64 can be included to provide uni-directional or bi-directional communication with the autonomous vehicles 10*a*-10*n*. This can be done using one or more communication satellites (not shown) and an uplink transmitting station (not shown). Uni-directional communication can include, for example, satellite radio services, wherein programming content (news, music, and the like) is received by the transmitting station, packaged for upload, and then sent to the satellite, which broadcasts the programming to subscribers. Bi-directional communication can include, for example, satellite telephony services using the satellite to relay telephone communications between the vehicle 10 and the station. The satellite telephony can be utilized either in addition to or in lieu of the wireless carrier system 60.

A land communication system 62 may further be included that is a conventional land-based telecommunications network connected to one or more landline telephones and connects the wireless carrier system 60 to the remote transportation system 52. For example, the land communication system 62 may include a public switched telephone network (PSTN) such as that used to provide hardwired telephony, packet-switched data communications, and the Internet infrastructure. One or more segments of the land communication system 62 can be implemented through the use of a standard wired network, a fiber or other optical network, a cable network, power lines, other wireless networks such as wireless local area networks (WLANs), or networks providing broadband wireless access (BWA), or any combination thereof. Furthermore, the remote transportation system 52 need not be connected via the land communication system 62, but can include wireless telephony equipment so that it can communicate directly with a wireless network, such as the wireless carrier system 60.

Although only one user device 54 is shown in FIG. 2, embodiments of the operating environment 50 can support any number of user devices 54, including multiple user devices 54 owned, operated, or otherwise used by one person. Each user device 54 supported by the operating environment 50 may be implemented using any suitable hardware platform. In this regard, the user device 54 can be realized in any common form factor including, but not limited to: a desktop computer; a mobile computer (e.g., a tablet computer, a laptop computer, or a netbook computer); a smartphone; a video game device; a digital media player; a component of a home entertainment equipment; a digital camera or video camera; a wearable computing device (e.g., smart watch, smart glasses, smart clothing); or the like. Each user device 54 supported by the operating environment 50 is realized as a computer-implemented or computer-based device having the hardware, software, firmware, and/or processing logic needed to carry out the various techniques and methodologies described herein. For example, the user device 54 includes a microprocessor in the form of a programmable device that includes one or more instructions stored in an internal memory structure and applied to receive binary input to create binary output. In some embodiments, the user device 54 includes a GPS module capable of receiving GPS satellite signals and generating GPS coordinates based on those signals. In other embodiments, the user device 54 includes cellular communications functionality such that the device carries out voice and/or data communications over the communication network 56 using one or more cellular communications protocols, as are discussed herein. In various embodiments, the user device 54 includes a visual display, such as a touch-screen graphical display, or other display.

The remote transportation system 52 includes one or more backend server systems, not shown), which may be cloud-based, network-based, or resident at the particular campus or geographical location serviced by the remote transportation system 52. The remote transportation system 52 can be manned by a live advisor, an automated advisor, an artificial intelligence system, or a combination thereof. The remote transportation system 52 can communicate with the user devices 54 and the autonomous vehicles 10*a*-10*n* to schedule rides, dispatch autonomous vehicles 10*a*-10*n*, and the like. In various embodiments, the remote transportation system 52 stores store account information such as subscriber authentication information, vehicle identifiers, profile records, biometric data, behavioral patterns, and other pertinent subscriber information. In one embodiment, as described in further detail below, remote transportation system 52 includes a route database 53 that stores information relating to navigational system routes, including lane markings for roadways along the various routes, and whether and to what extent particular route segments are impacted by construction zones or other possible hazards or impediments that have been detected by one or more of autonomous vehicles 10*a*-10*n*.

In accordance with a typical use case workflow, a registered user of the remote transportation system 52 can create a ride request via the user device 54. The ride request will typically indicate the passenger's desired pickup location (or current GPS location), the desired destination location (which may identify a predefined vehicle stop and/or a user-specified passenger destination), and a pickup time. The remote transportation system 52 receives the ride request, processes the request, and dispatches a selected one of the autonomous vehicles 10*a*-10*n* (when and if one is available) to pick up the passenger at the designated pickup location and at the appropriate time. The transportation system 52 can also generate and send a suitably configured confirmation message or notification to the user device 54, to let the passenger know that a vehicle is on the way.

As can be appreciated, the subject matter disclosed herein provides certain enhanced features and functionality to what may be considered as a standard or baseline autonomous vehicle 10 and/or an autonomous vehicle based remote transportation system 52. To this end, an autonomous vehicle and autonomous vehicle based remote transportation system can be modified, enhanced, or otherwise supplemented to provide the additional features described in more detail below.

Figure 3:
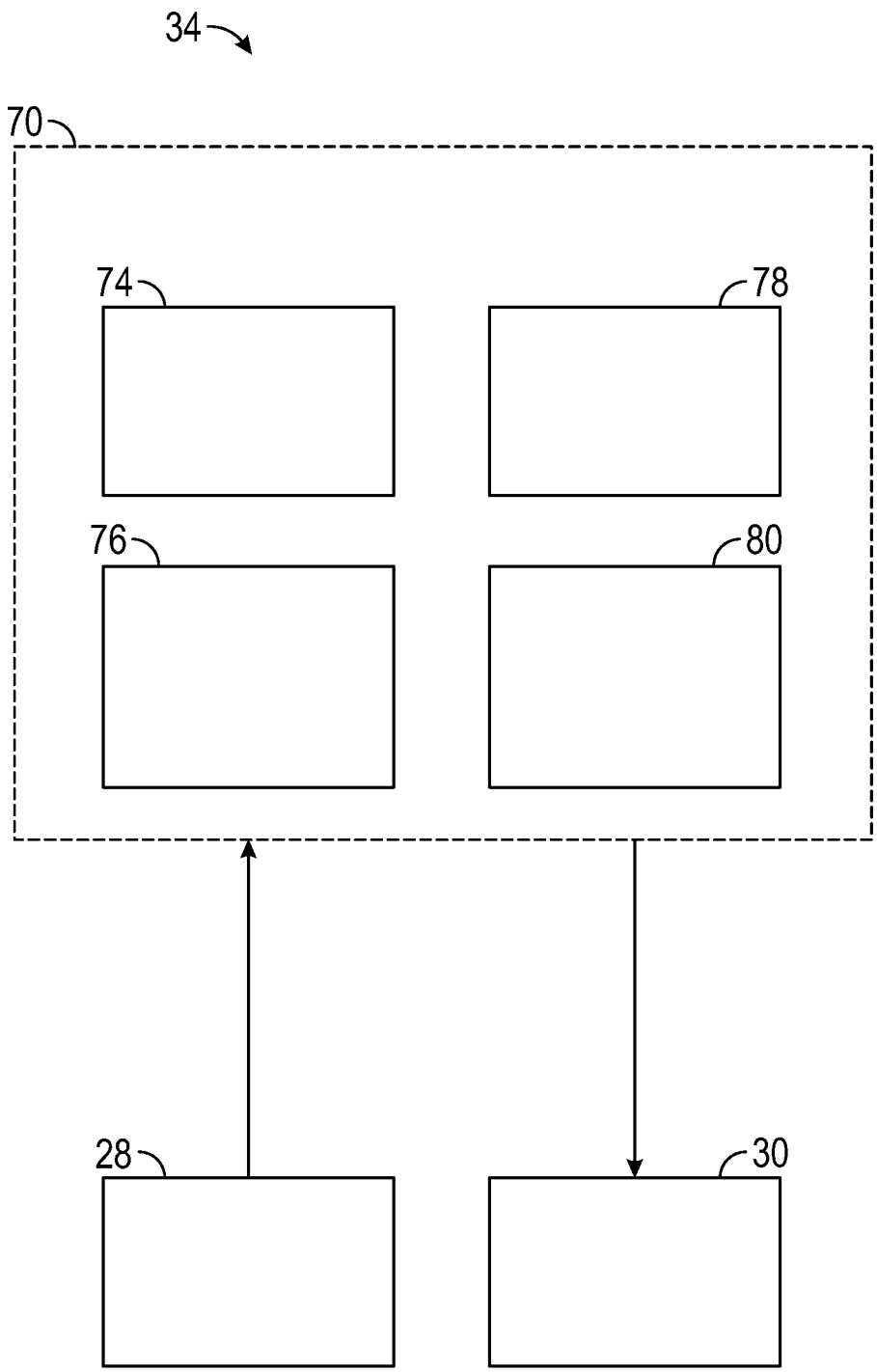
FIG. 3 is functional block diagram illustrating an autonomous driving system (ADS) associated with an autonomous vehicle, in accordance with various embodiments.

In accordance with various embodiments, controller 34 implements an autonomous driving system (ADS) as shown in FIG. 3. That is, suitable software and/or hardware components of controller 34 (e.g., processor 44 and computer-readable storage device 46) are utilized to provide an ADS that is used in conjunction with vehicle 10.

In various embodiments, the instructions of the autonomous driving system 70 may be organized by function or system. For example, as shown in FIG. 3, the autonomous driving system 70 can include a sensor fusion system 74, a positioning system 76, a guidance system 78, and a vehicle control system 80. As can be appreciated, in various embodiments, the instructions may be organized into any number of systems (e.g., combined, further partitioned, etc.) as the disclosure is not limited to the present examples.

In various embodiments, the sensor fusion system 74 synthesizes and processes sensor data and predicts the presence, location, classification, and/or path of objects and features of the environment of the vehicle 10. In various embodiments, the sensor fusion system 74 can incorporate information from multiple sensors, including but not limited to cameras, lidars, radars, and/or any number of other types of sensors.

The positioning system 76 processes sensor data along with other data to determine a position (e.g., a local position relative to a map, an exact position relative to lane of a road, vehicle heading, velocity, etc.) of the vehicle 10 relative to the environment. The guidance system 78 processes sensor data along with other data to determine a path for the vehicle 10 to follow. The vehicle control system 80 generates control signals for controlling the vehicle 10 according to the determined path.

In various embodiments, the controller 34 implements machine learning techniques to assist the functionality of the controller 34, such as feature detection/classification, obstruction mitigation, route traversal, mapping, sensor integration, ground-truth determination, and the like.

With reference back to FIG. 1, in various embodiments, one or more instructions of the controller 34 are embodied in the door actuator control system 100 of FIG. 1. As mentioned briefly above, the door actuator control system 100 of FIG. 1 controls operation of actuators of the doors 11 of the vehicle 10.

Figure 4:
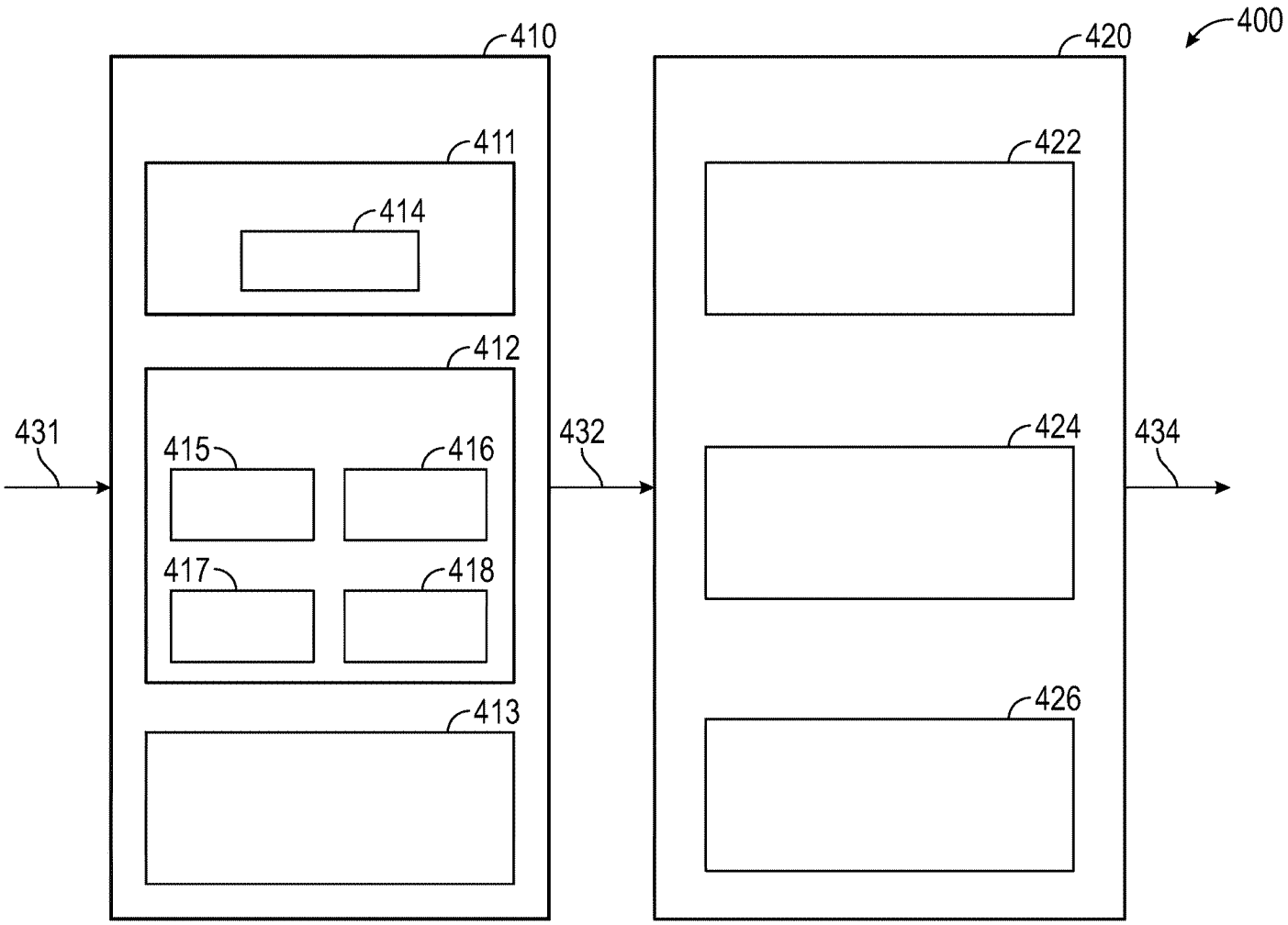
FIG. 4 is a dataflow diagram illustrating a door opening control system for autonomous vehicles, in accordance with various embodiments.

Referring to FIG. 4, an exemplary door actuator control system 400 generally includes a door actuator object module 410 and a door actuator determination module 420. In various embodiments, the door actuator object module 410 is disposed onboard the vehicle 10, for example as part of the sensor system 20 of FIG. 1. Also in the depicted embodiment, the door actuator object module 410 includes an interface 411, sensors 412, and a transceiver 413.

In various embodiments, the interface 411 includes an input device 414. The input device 414 receives inputs from a user (e.g., an occupant) of the vehicle 10. In certain embodiments, the user inputs include inputs as to a desired destination for the current vehicle ride. Also in certain embodiments, the user inputs include a request, when appropriate, for an opening of one or more doors 11 of the vehicle 10. In certain embodiments, the input device 414 may include one or more touch screens, knobs, buttons, microphones, and/or other devices. In various embodiments, the sensors 412 include one or more cameras 415, motion sensors 416, lidar sensors 417, and/or other sensors 418 (e.g. transmission sensors, wheel speed sensors, accelerometers, and/or other types of sensors).

In addition, in various embodiments, the transceiver 413 communicates with the door actuator determination module 420, for example via one or more wired and/or wireless connections, such as the communication network 56 of FIG. 2. Also in various embodiments, the transceiver 413 also communicates with one or more sources of information that are remote from the vehicle 10 (such as one or more global positioning system (GPS) satellites, for example via one or more wireless connections, such as the communication network 56 of FIG. 2. In addition, in certain embodiments, the transceiver 413 also receives inputs from the user (such as a requested destination and/or a request to open a door 11), for example from the user device 54 of FIG. 2 (e.g., via one or more wired or wireless connections, such as the communication network 56 of FIG. 2).

Also in various embodiments, the door actuator determination module 420 is also disposed onboard the vehicle 10, for example as part of the controller 34 of FIG. 1. Also in the depicted embodiment, the door actuator determination module 420 includes a processor 422, a memory 424, and a transceiver 426.

In various embodiments, the processor 422 makes various determinations and provides control of the actuators 42 of FIG. 1 for opening the doors 11 of the vehicle 10 of FIG. 1, and provides instructions for operation of the actuators 42. Also in various embodiments, the processor 422 of FIG. 4 corresponds to the processor 44 of FIG. 1.

In various embodiments, the memory 424 stores various information for use by the processor 422 in controlling operation of the actuators 42, such as data pertaining to particular operators of the vehicle 10, baseline instructions for operation of an actuator for opening doors 11 of the vehicle 10, and/or other information pertaining to the opening of the doors 11. Also in various embodiments, the memory 424 is part of the data storage device 32 of FIG. 1. In various embodiments, the transceiver 426 communicates with the door actuator object module 410, for example via one or more wired and/or wireless connections, such as the communication network 56 of FIG. 2. Also in various embodiments, the transceiver 426 also facilitates the transmission of instructions from the processor 422 to the actuators 42, for example via one or more wired and/or wireless connections, such as the communication network 56 of FIG. 2.

With further reference to FIG. 4, in various embodiments inputs 431 are provided to the door actuator object module 410. In various embodiments, the inputs 431 comprise instructions provided by one or more users (e.g., occupants) of the vehicle 10, for example as to a requested destination for the vehicle 10 and/or a request to open one or more doors 11 of the vehicle 10. Also in various embodiments, the inputs 431 from the occupant are received via the input device 414 and/or the transceiver 413 (e.g., from user device 54 of FIG. 2). In addition, in various embodiments, the inputs 431 for the door actuator object module 410 may further comprise data from one or more remote data sources (e.g., GPS satellites, among other possible data sources), for example as received via the transceiver 413.

Also with further reference to FIG. 4, in various embodiments the door actuator object module 410 provides outputs 432 that serve as inputs for the door actuator determination module 420. In various embodiments, the outputs 432 of the door actuator object module 410 (or, the inputs for the door actuator determination module 420) comprise information used by the door actuator determination module 420 for use in controlling the actuators 42 for controlling the doors 11 of FIG. 1. For example, in various embodiments, the outputs 432 comprise sensor data obtained from the various sensors 412 (e.g. camera data, motion data, lidar data, and other data pertaining to the operation of the vehicle 10 and/or its cabin and/or surroundings), as well as information pertaining to the above-described user inputs and information from third party data sources (e.g., GPS satellites). Also in certain embodiments, the outputs 432 are provided from the transceiver 413 of the door actuator object module 410 to the door actuator determination module 420 (e.g., via a wired or wireless connection).

Also as depicted in FIG. 4, in various embodiments the door actuator determination module 420 provides outputs 434. In various embodiments, the outputs 434 of the door actuator determination module comprise instructions from the processor 422 to the actuators 42 of the doors 11 of FIG. 1 for opening the doors 11. Also in certain embodiments, the outputs 432 are provided from the transceiver 413 of the door actuator object module 410 of FIG. 4 to the actuators 42 of FIG. 1 (e.g., via a wired or wireless connection).

Figure 5:
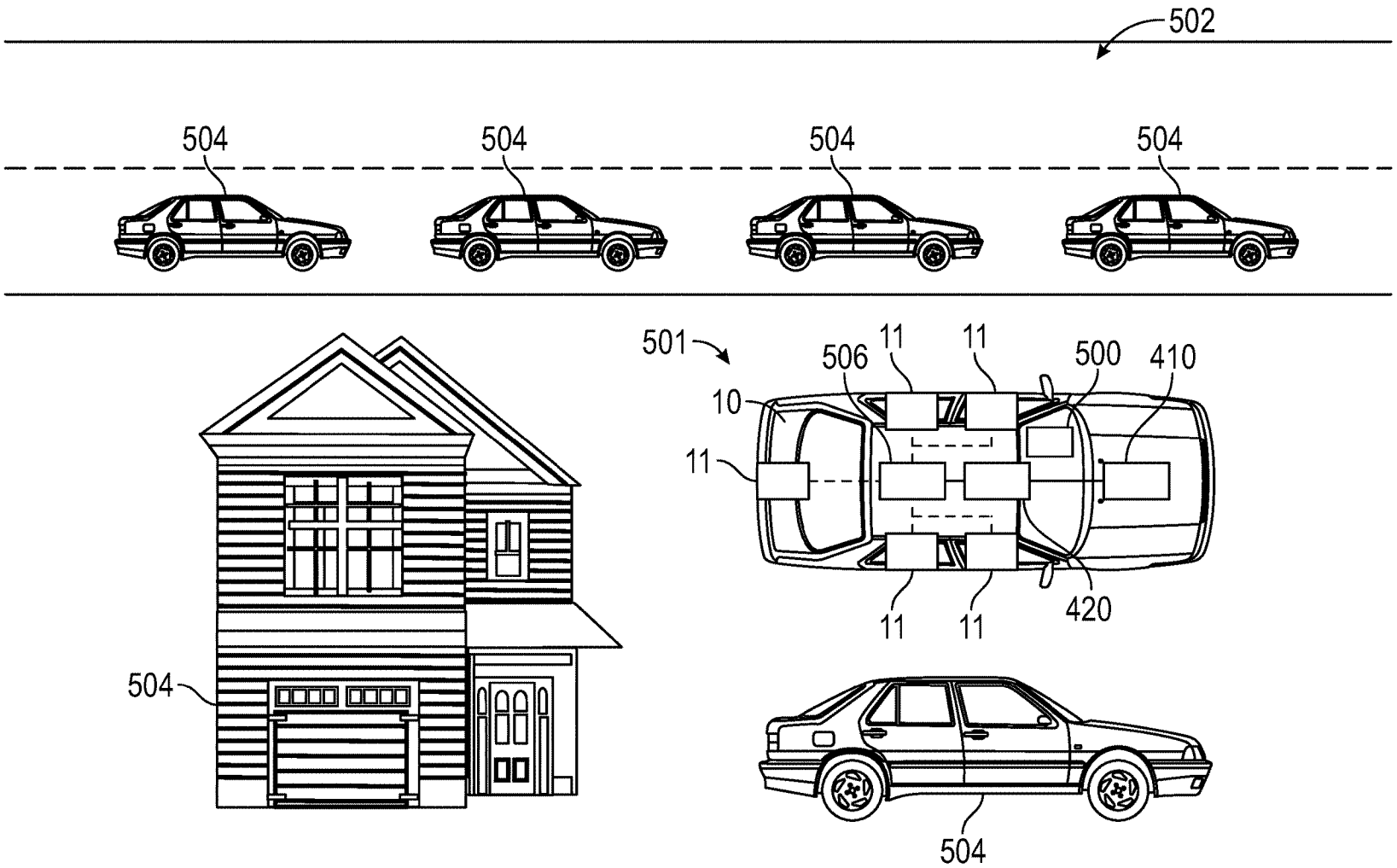
FIG. 5 is a schematic diagram of an autonomous vehicle on a roadway with circumstances potentially warranting an adjustment for an actuator's opening of one or more doors of an autonomous vehicle, in accordance with various embodiments.

Turning now to FIG. 5, a schematic diagram is provided of the autonomous vehicle 10 in a particular environment, in accordance with various embodiments. As depicted in FIG. 5, in various embodiments the vehicle 10 includes one or more occupants 500. Also as depicted in FIG. 5, the vehicle 10 includes one or more door actuators 506 (e.g., corresponding to some or all of the actuators 42 of FIG. 1) as well as various doors 11. In certain embodiments, the door actuators 506 are configured to unlock the doors 11. In certain other embodiments, the door actuators 506 are configured to open the doors 11. In still other embodiments, the door actuators 506 are configured to unlock and open the doors 11. Also as depicted in FIG. 5, the door actuators 506 are coupled between the doors 11 and the door actuator determination module 420 of FIG. 4, and the door actuator determination module 420 is coupled between the door actuators 506 and the door actuator object module 410 of FIG. 4. The doors 11 may be disposed on various locations of the vehicle 10, for example front and rear doors 11 on both side of the vehicle 10, along with one or more rear door(s) 11 (e.g., a rear hatch and/or a rear trunk), among other possible locations.

In the depicted embodiment, the vehicle 10 is currently disposed in a location 501 that is proximate a roadway 502. Also in various embodiments, various objects (also referred to herein as obstacles) 504 are depicted as being detected by the door actuator object module 410. In accordance with various embodiments, the door actuator determination module 420 determines whether any changes are required to a baseline instruction for the door actuators, based on the information provided by the door actuator object module 410, once a door opening request is received by the door actuator object module 410. For example, if one or more objects 504 are likely to be contacted by an opening of one of the doors 11, and/or if one or objects 504 are likely to potentially cause a problem for the occupant 500 and/or the vehicle 10 if the door 11 is opened, then the baseline instructions may be adjusted accordingly (e.g., to prevent, delay, or otherwise alter the opening of the door 11). Similar adjustments may be made, for example, if the location 501 is not conducive to door opening and/or occupants leaving the vehicle, or if there is an accessibility issue with the occupant 500 and/or detected motion inside the cabin of the vehicle 10 that may be problematic, and so on. In various embodiments, instructions are provided by the door actuator determination module 420 to the door actuator 506 that incorporate any such adjustments.

Figure 6:
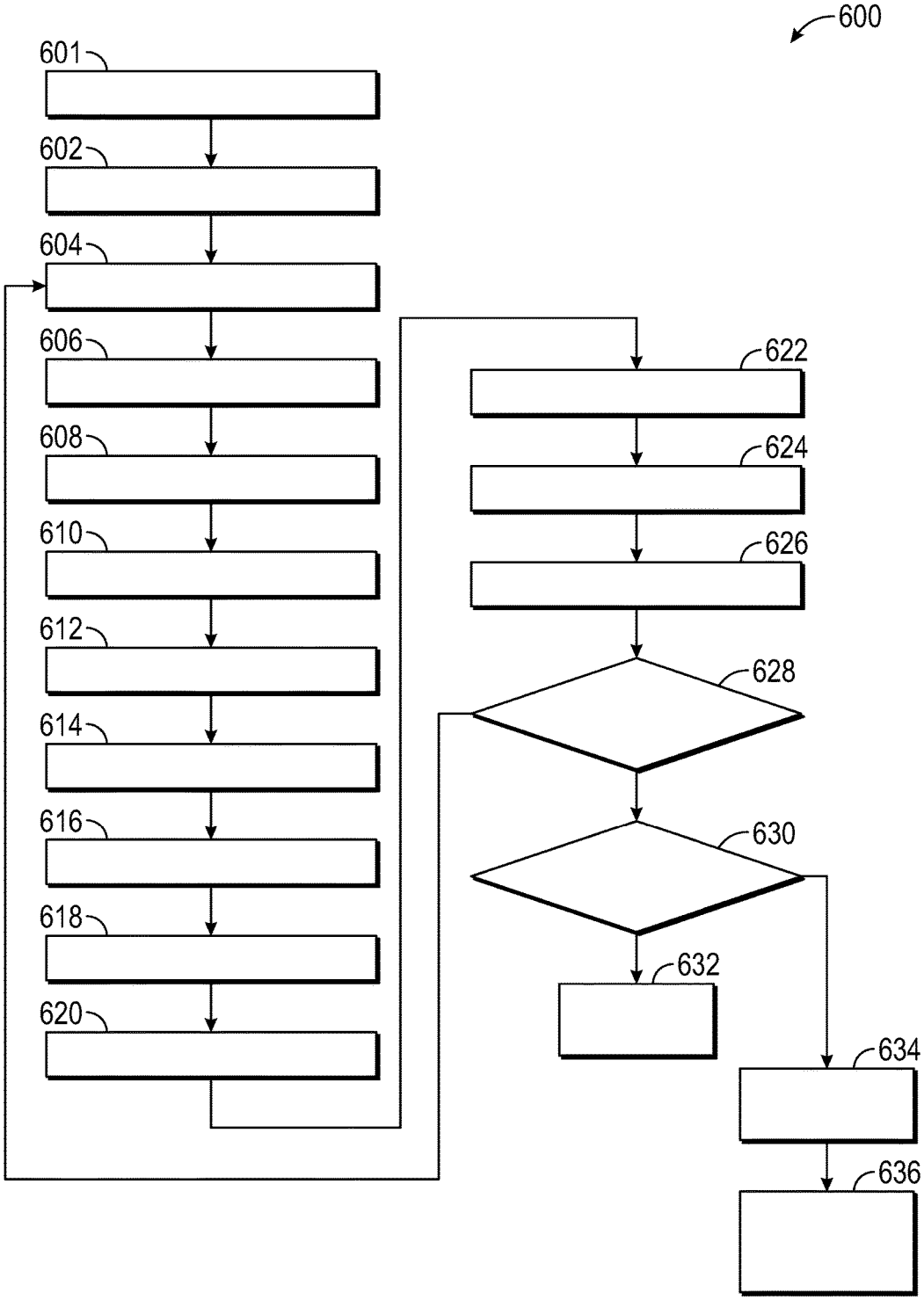
FIG. 6 is a flowchart for a control process for controlling an actuator of a door for an autonomous vehicle, in accordance with various embodiments.

Referring now to FIG. 6, a flowchart is provided for a control method 600 for controlling door actuators in an autonomous vehicle, in accordance with various embodiments. The control method 600 is discussed below in connection with FIG. 6 as well as continued reference to FIGS. 1-5. In various embodiments, the control method 600 can be performed by the system 100 and the associated implementations of FIGS. 1-5, in accordance with exemplary embodiments. As can be appreciated in light of the disclosure, the order of operation within the method is not limited to the sequential execution as illustrated in FIG. 6, but may be performed in one or more varying orders as applicable and in accordance with the present disclosure. In various embodiments, the control method 600 can be scheduled to run based on one or more predetermined events, and/or can run continuously during operation of the autonomous vehicle 10.

In various embodiments, the control method 600 may begin at 601. In various embodiments, 601 occurs when an occupant is within the vehicle 10 and the vehicle 10 begins operation in an automated manner.

Baseline instructions are obtained at 602. In various embodiments, the baseline instructions refer to baseline instructions for the opening of one or more doors 11 of the vehicle 10 of FIG. 1 (e.g., under ordinary or standard circumstances, in which there is not a particular need to provide adjusted instructions). In certain embodiments, the baseline instructions are for the door actuators (e.g., the door actuators 506 of FIG. 5) to provide full opening of the requested door(s) 11, in accordance with occupant instructions for door opening. Also in certain embodiments, the baseline instructions are retrieved by the processor 422 of FIG. 4 from memory, such as the memory 424 of FIG. 4.

Passenger inputs are obtained at 604. In various embodiments, the passenger inputs pertain to a desired destination for travel via the vehicle 10. In various embodiments, the user inputs may be obtained via the input device 414 of FIG. 4 and/or the user device 54 of FIG. 2 (e.g., via the transceiver 413 of FIG. 4).

Map data is obtained at 606. In various embodiments, map data is retrieved from a memory, such as the memory 424 of FIG. 4 (e.g., corresponding to the data storage device 32 of FIG. 1, onboard the vehicle 10). In certain embodiments, the map data may be retrieved from the route database 53 of the autonomous vehicle based remote transportation system 52 of FIG. 2. Also in various embodiments, the map data comprises maps and associated data pertaining to roadways that are near the vehicle 10 and/or that are near or on the way from the vehicle 10's current to its destination (e.g., per the passenger inputs).

Occupant information is obtained at 608. In various embodiments, identification of one or more present occupants 500 of FIG. 5 within the vehicle 10 is detected via the door actuator object module 410 of FIG. 4. In certain embodiments, the occupants are identified via user inputs (e.g. the occupant providing information as to his or her identity, for example by entering information on a screen, pressing a button, rotating a knob, providing verbal information, sending an electronic message, and so on), for example via the input device 414 of FIG. 4 and/or the user device 54 of FIG. 2 (e.g., via an occupant's mobile phone or other electronic device and received via the transceiver 413 of FIG. 4). In certain other embodiments, the transceiver 413 may receive a message that is automatically provided (e.g., via a keyfob of the occupant), and/or may obtain sensor data pertaining to the occupant (e.g., via a camera 415 of FIG. 4).

A determination is made at 610 as to whether there are any accessibility issues pertaining to the occupant. In various embodiments, an occupant may be considered to have an accessibility issue if the baseline instructions for door opening would preferably be modified for the particular occupant. In various embodiments, such modifications may include, by way of example, a delay prior to opening the door, an opening of the door more slowly or quickly than normal, opening a door a greater or lesser distance than normal, opening multiple doors instead of a single door (or vice versa), and so on. For example, in certain embodiments, an occupant may have an accessibility issue if the occupant uses a wheelchair, cane, and/or walker, has difficulty getting out of the vehicle 10, or the like. Also in certain embodiments, an occupant may have an accessibility issue if the occupant is pregnant. In addition, in certain embodiments, an accessibility issue may be determined to be present if one or more of the occupants has an age that is below a predetermined threshold age (e.g., if the occupant is a child) or has special needs, and so on. In various embodiments, the determination of 610 is provided by the processor 422 of FIG. 4 using the data obtained at 608.

Also in various embodiments, sensor data is obtained at 612. In various embodiments, data is obtained from the various sensors 412 of FIG. 4. For example, in various embodiments, camera data is obtained from the cameras 415 of FIG. 4 (e.g., of surroundings pertaining to the vehicle 10), motion of the occupants 500 inside the vehicle 10 is detected via the motion sensors 416 of FIG. 4, objects (e.g., objects 504 of FIG. 5) in proximity to the vehicle 10 are detected and monitored using the lidar sensors 417 of FIG. 4, and various other data is obtained via the other sensors 418 of FIG. 4 (e.g., further detection and tracking of objects using sonar, radar, and/or other sensors, obtaining measurements pertaining to the vehicle's speed and acceleration via wheel speeds sensors and accelerometers, and so on).

In various embodiments, other data is obtained at 614. In various embodiments, the other data is obtained at 614 via the transceiver 413 from or utilizing one or more remote data sources. By way of example, in certain embodiments, the other data of 614 may include GPS data using one or more GPS satellites, weather, constructions, and/or traffic data from one or more remote sources that may have an impact on route selection and/or other operation of the vehicle 10, and/or one or more various other types of data.

A path for the autonomous vehicle is planned and implemented at 616. In various embodiments, the path is generated and implemented via the ADS 70 of FIG. 3 for the vehicle 10 of FIG. 1 using the passenger inputs of 604 and the map data of 606, for example via automated instructions provided by the processor 422. In various embodiments, the path of 616 comprises a path of movement of the vehicle 10 that would be expected to facilitate movement of the vehicle 10 to the intended destination while maximizing an associated score and/or desired criteria (e.g., minimizing driving time, maximizing safety and comfort, and so on). It will be appreciated that in various embodiments the path may also incorporate other data, for example such as the sensor data of 612 and/or the other data of 614. In various embodiments, the path for the vehicle 10 is planned and implemented using the processor 422 of FIG. 4.

A current location of the vehicle is determined at 618. In various embodiments, the current location is determined by the processor 422 using information obtained from 604, 606, 612 and/or 614. For example, in certain embodiments, the current location is determined using a GPS and/or other location system, and/or is received from such system. In certain other embodiments, the location may be determined using other sensor data from the vehicle (e.g. via user inputs provided via the input device 414 and/or received via the transceiver 413, camera data and/or sensor information combined with the map data, and so on).

A ride state of the vehicle is determined at 620. In certain embodiments, the ride state comprises a state of the current ride of the vehicle 10 in relation to a requested destination for the current ride. For example, in one embodiment, the ride state comprises whether the vehicle 10 of FIG. 1 has reached its intended destination. In certain other embodiments, the ride state may pertain to one or more other characteristics of the current ride of the vehicle 10, for example as to whether the vehicle 10 is moving, an amount of time for which the vehicle 10 has remained stationary, and so on. In various embodiments, the ride state is determined by the processor 422 of FIG. 4.

In various embodiments, monitoring is performed at 622 regarding objects in proximity to the vehicle 10. Specifically, in various embodiments, the sensor data of 612 is monitored and analyzed with respect to objects that are in proximity to the vehicle. Also in various embodiments, determinations are made with respect to a measure of proximity (e.g., in terms of distance and/or time) from the vehicle 10, as well as with respect to movement of the objects, paths of the objects (and possibility overlap with or close proximity to the vehicle 10 and/or a path thereof), and so on. In various embodiments, the monitoring, assessments, and determinations of 622 are performed and/or facilitated by the processor 422 of FIG. 4.

In addition, in various embodiments, monitoring is performed at 624 regarding movement of the vehicle 10. Specifically, in various embodiments, the sensor data of 612 is monitored and analyzed with respect to velocity, acceleration, and/or trajectory of the vehicle 10. In various embodiments, the monitoring, assessments, and determinations of 624 are performed and/or facilitated by the processor 422 of FIG. 4 utilizing data provided by one or more sensors 412 of FIG. 4 (e.g., wheel speed sensors, accelerometers, or the like).

Also in various embodiments, monitoring is performed at 626 regarding motion inside the vehicle 10 (e.g., inside a passenger cabin of the vehicle 10). Specifically, in various embodiments, the sensor data of 612 is monitored and analyzed with respect to movement and/or other activity of occupants within the vehicle 10. Also in various embodiments, determinations are made with respect to whether the occupants may be too close to the doors 11 of the vehicle 10, whether the occupants are behaving in an unruly or unorthodox manner, whether the occupants are inebriated, whether the occupants are sleeping, and so on. In various embodiments, the monitoring, assessments, and determinations of 626 are performed and/or facilitated by the processor 422 of FIG. 4 utilizing data provided by one or more sensors 412 of FIG. 4 (e.g., motion sensors 416 of FIG. 4).

A determination is made at 628 as to whether a door opening and/or unlocking request has been received. In certain embodiments, the door opening request comprises a request made by an occupant of the vehicle 10 for an opening and/or unlocking of one or more doors 11 of FIG. 1. For example, in various embodiments the request may be to open a particular single door 11, and/or particular multiple doors 11, and/or all of the doors of the vehicle 10 of FIG. 1. Also in certain embodiments, the processor 422 of FIG. 4 determines when a door opening request has been made based on such inputs. In certain other embodiments, the door opening request may be determined (e.g. by the processor 422 of FIG. 4) automatically based on one or more other criteria, such as an occupant's engagement of a door handle or door lock (e.g. as determined based on sensor data), a determination that the vehicle 10 has reached its destination, and so on.

If it is determined at 628 that a door opening and/or unlocking request has not been made, then the process returns to the above-described 604. The process thereafter repeats, preferably including 604-628, in various iterations until a determination is made in a subsequent iteration of 628, that a door opening request has been made.

Once it is determined in an iteration of 628 that a door opening and/or unlocking request has been made, a determination is made at 630 as to whether one or more special conditions are present that would affect opening of the vehicle doors 11. Specifically, in various embodiments, at 630 a determination is made by the processor 422 of FIG. 4 as to whether one or more conditions are present that would require or call for an adjustment to the baseline instructions for opening and/or unlocking one or more vehicle doors 11.

For example, in certain embodiments, such a special condition may be determined at 630 based on an identification of the occupant (e.g. occupant 500 of FIG. 5) and/or characteristics of the occupant (e.g., as determined by the processor 422 of FIG. 4 via the monitoring at the above-described 610). Specifically, in certain embodiments, if it has been determined at 610 that one or more occupants have an accessibility issue (e.g., per the discussion above, if the occupant uses a wheelchair, cane, and/or walker, has difficulty getting out of the vehicle 10, is pregnant, has an age that is below a predetermined threshold, or has special needs, and so on).

In addition, in certain embodiments, such a special condition may be determined at 630 based on a location of the vehicle 10 (e.g., as determined by the processor 422 of FIG. 4 via the monitoring at the above-described 618). For example, in certain embodiments, if the vehicle 10 is parked in a location that may be problematic for opening one or more of the doors 11 (e.g., if the vehicle 10 is disposed on a busy roadway, or is stopped too close to traffic, or is parked too close to another vehicle, person, animal, or other object), then such a special condition would be deemed to exist. Similarly, if the location would potentially cause an issue for some but not all of the doors 11, or for opening the doors 11 in some manners but not others (e.g. opening the doors 11 all of the way versus partially, and so on), then the special condition would still be deemed to exist, in certain embodiments.

By way of further example, in certain embodiments, such a special condition may also be determined at 630 based on a ride state of the vehicle 10 (e.g., as determined by the processor 422 of FIG. 4 via the monitoring at the above-described 620). For example, in certain embodiments, if the vehicle 10 has not yet reached its intended destination, then such a special condition would be deemed to exist.

By way of additional example, in certain embodiments, such a special condition may also be determined at 630 based on detected objects in proximity to the vehicle. 10 (e.g., as determined by the processor 422 of FIG. 4 via the monitoring at the above-described 622). For example, in certain embodiments, if the one or more detected objects (e.g., corresponding to objects 504 of FIG. 5) are within a predetermined distance or time of from the vehicle 10, then such a special condition would be deemed to exist. Additionally, in various embodiments, such a special condition would also be deemed to exist if one or more of the objects is likely (e.g., based on a current or projected trajectory) to contact the vehicle 10 and/or to come close enough to the vehicle to potentially be problematic (e.g., such that if the object may come into contact with the door 11 when the door opens, and/or if the object may come too close to contacting an occupant upon exiting the vehicle 10 through an opened door, and so on). For example, in certain embodiments, if the vehicle 10 is deemed to be sufficiently close to a flow of traffic and/or to a detected object and/or the anticipated flow of traffic and/or path of a detected object, then such a special condition would be determined at 630.

By way of another example, in certain embodiments, such a special condition may also be determined at 630 based on movement of the vehicle 10 (e.g., as determined by the processor 422 of FIG. 4 via the monitoring at the above-described 624). For example, in certain embodiments, if the vehicle 10 is still moving, and/or has not stopped moving for at least a predetermined amount of time (e.g., a few minutes, in one embodiment, although this may vary in different embodiments) then the special condition would also be deemed to exist.

Moreover, by way of further example, in certain embodiments, such a special condition may also be determined at 630 based on motion inside the vehicle 10 (e.g., as determined by the processor 422 of FIG. 4 via the monitoring at the above-described 626). For example, in certain embodiments, if the motion (or lack of motion) of the occupants inside the cabin of the vehicle 10 indicates that the occupants are behaving in an unruly or unorthodox manner, and/or the occupants are inebriated or sleeping, and so on.

If it is determined at 630 that a special condition is not present with respect to opening of the doors 11, then the door(s) are opened as normal at 632. Specifically, in various embodiments, the processor 422 of FIG. 4 provides instructions to one or more actuators 506 of FIG. 5 for opening of one or more corresponding door(s) 11 in accordance with the baseline instructions of 602, which are then implemented by the actuators 506 in opening the respective door(s) 11.

Conversely, if it is instead determined at 630 that a special condition is present with respect to opening of the doors 11, then modified instructions are generated at 634. Specifically, in various embodiments, the processor 422 of FIG. 4 generates alternate instructions at 634 than comprise one or more adjustments of the baseline instructions of 602 based on the special condition(s) determined at 630.

For example, in certain embodiments of 634, the alternate instructions may provide for a delay (or, in certain cases, the absence of a delay) in opening and/or unlocking the door(s) 11 based on the special condition(s). For example, in certain embodiments, a delay may be initiated prior to the door opening and/or unlocking if an oncoming obstacle is about to pass the vehicle 10, or another situation inside or outside the vehicle 10 is about to be resolved shortly, or the like.

By way of additional example, in certain embodiments of 634, the alternate instructions may provide for certain door(s) 11, but not other door(s), of the vehicle 10 to be opened. For example, if detected objects are proximate certain doors 11 but are not proximate other doors, then only the doors 11 that are not proximate the objects may be opened and/or unlocked in certain embodiments, and so on. Similarly, in certain embodiments, if an occupant requiring special attention (e.g., a young child) is located by one door and a parent or guardian is located by another door, then only the parent's door may be opened and/or unlocked in certain embodiments, and so on.

By way of further example, in certain embodiments of 634, the alternate instructions may provide for only a partial opening of the door(s) 11 versus a full opening of the door(s) in the baseline instructions. For example, in certain embodiments, the door(s) 11 may be opened only partially under special conditions in which obstacles are present at a distance from the vehicle 10 that would prevent a full opening of the door(s) but that would not prevent a partial opening of the door(s), or the like.

By way of another example, in certain other embodiments of 634, the alternate instructions may provide for a full opening of the door(s) versus a partial opening of the door(s) in the baseline instructions. For example, in certain embodiments the door(s) 11 may be opened more fully under special conditions in which an occupant requiring additional room and/or assistance in exiting the vehicle 10, for example if the occupant utilizes a cane, wheelchair, or walker, and so on.

By way of a further example, in certain other embodiments of 634, the alternate instructions may provide for an opening of the door(s) such that the door(s) remain open for a longer period of time as compared with the baseline instructions. For example, in certain embodiments the door(s) 11 may be opened for a longer period of time under special conditions in which an occupant requires additional assistance and/or time in existing the vehicle 10, for example if the occupant utilizes a cane, wheelchair, or walker, and so on.

Assistance instructions are provided and implemented at 636. In various embodiments, the alternate instructions of 634 are provided by the processor 422 of FIG. 4 (e.g., corresponding to the processor 44 of FIG. 1) to the actuators 506 of FIG. 5 (e.g., via the transceiver 426 of FIG. 4) for opening of respective doors 11 in accordance with the adjustments that were made based on the special conditions. Also in various embodiments, the alternate instructions are then implemented by the actuators 506 of FIG. 5 (e.g., corresponding to actuators 42 of FIG. 1) in opening the doors 11.

In various embodiments, the disclosed methods and systems provide for adjustment of baseline instructions for door actuators based on one or more special conditions. For example, in various embodiments, when such special conditions (e.g., pertaining to accessibility issues of the occupants, and/or pertaining to the location, ride state, detected objects, vehicle movement, motion inside the vehicle, or the like) are present, a processor generates and provides alternate instructions to the door opening actuators that modifies the baseline door opening to account for the specific special conditions.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for controlling an actuator for a door of an autonomous vehicle, the method comprising:

obtaining, via one or more sensors, data pertaining to a current ride of the autonomous vehicle during operation of the autonomous vehicle;

identifying, via a processor using the data, whether one or more circumstances are present that would require an adjustment of a baseline instruction for an automatic opening of the door by the autonomous vehicle via the actuator;

determining, via the processor, the adjustment of the baseline instruction when one or more of the circumstances are present;

receiving, via the processor, a request to open the door; and upon receiving the request:

providing, via the processor, the baseline instruction for the actuator to open the door, when none of the circumstances are present; and providing, via the processor, an alternate instruction for the actuator, based on the adjustment, when one or more of the circumstances are present.

2. The method of claim 1, wherein the adjustment comprises a change in whether the door is automatically opened by the autonomous vehicle upon receiving the request.

3. The method of claim 1, wherein the adjustment comprises a change in a rate of speed in which the door is automatically opened by the autonomous vehicle upon receiving the request.

4. The method of claim 1, wherein the adjustment comprises a change in a distance to which the door is automatically opened by the autonomous vehicle upon receiving the request.

5. The method of claim 1, wherein:

the obtaining of the data comprises obtaining data as to a geographic location in which the autonomous vehicle is travelling; and the determining of the adjustment comprises determining the adjustment of the baseline instruction based on the geographic location.

6. The method of claim 1, wherein:

the obtaining of the data comprises obtaining data as to a status of the current ride for the autonomous vehicle; and the determining of the adjustment comprises determining the adjustment of the baseline instruction based on the status of the current ride.

7. The method of claim 1, wherein:

the obtaining of the data comprises obtaining data as to one or more objects detected in proximity to the autonomous vehicle; and the determining of the adjustment comprises determining the adjustment of the baseline instruction based on the one or more detected objects.

8. The method of claim 1, wherein:

the obtaining of the data comprises obtaining data as to an accessibility characteristic of an occupant of the autonomous vehicle; and the determining of the adjustment comprises determining the adjustment of the baseline instruction based on the accessibility characteristic of the occupant.

9. The method of claim 1, wherein:

the obtaining of the data comprises obtaining data as to detected motion inside the autonomous vehicle; and the determining of the adjustment comprises determining the adjustment of the baseline instruction based on the detected motion inside the autonomous vehicle.

10. A system for controlling an actuator for a door of an autonomous vehicle, the system comprising:

one or more sensors configured to:

generate data pertaining to a current ride of the autonomous vehicle during operation of the autonomous vehicle; and receive a request to open the door; and a processor coupled to the one or more sensors and configured to:

identify whether one or more circumstances are present that would require an adjustment of a baseline instruction for an automatic opening of the door by the autonomous vehicle via the actuator based on instructions provided to the actuator by the processor; and determine the adjustment of the baseline instruction when one or more of the circumstances are present; and upon receiving the request:

provide the baseline instruction for the actuator to open the door, when none of the circumstances are present; and provide an alternate instruction for the actuator, based on the adjustment, when one or more of the circumstances are present.

11. The system of claim 10, wherein the adjustment comprises a change in whether the door is automatically opened by the autonomous vehicle upon receiving the request.

12. The system of claim 10, wherein the adjustment comprises a change in a rate of speed in which the door is automatically opened by the autonomous vehicle upon receiving the request.

13. The system of claim 10, wherein the adjustment comprises a change in a distance to which the door is automatically opened by the autonomous vehicle upon receiving the request.

14. The system of claim 10, wherein:

the one or more sensors are configured to obtain data as to a geographic location in which the autonomous vehicle is travelling; and the processor is configured to determine the adjustment of the baseline instruction based on the geographic location.

15. The system of claim 10, wherein:

the one or more sensors are configured to generate data as to a status of the current ride for the autonomous vehicle; and the processor is configured to determine the adjustment of the baseline instruction based on the status of the current ride.

16. The system of claim 10, wherein:

the one or more sensors are configured to generate data as to one or more objects detected in proximity to the autonomous vehicle; and the processor is configured to determine the adjustment of the baseline instruction based on the one or more detected objects.

17. The system of claim 10, wherein:

the one or more sensors are configured to generate data as to an accessibility characteristic of an occupant of the autonomous vehicle; and the processor is configured to determine the adjustment of the baseline instruction based on the accessibility characteristic of the occupant.

18. The system of claim 10, wherein:

the one or more sensors are configured to generate data as to detected motion inside the autonomous vehicle; and the processor is configured to determine the adjustment of the baseline instruction based on the detected motion inside the autonomous vehicle.

19. An autonomous vehicle comprising:

a door;

an actuator configured to open the door;

one or more sensors configured to generate data pertaining to a current ride of the autonomous vehicle during operation of the autonomous vehicle; and a processor coupled to the one or more sensors and configured to:

identify whether one or more circumstances are present that would require an adjustment of a baseline instruction for an automatic opening of the door by the autonomous vehicle via the actuator based on instructions provided to the actuator by the processor;

determine the adjustment of the baseline instruction when one or more of the circumstances are present;

receive a request to open the door; and upon receiving the request:

provide the baseline instruction for the actuator to open the door, when none of the circumstances are present; and provide an alternate instruction for the actuator, based on the adjustment, when one or more of the circumstances are present.

20. The autonomous vehicle of claim 19, further comprising:

a memory coupled to the processor and configured to store the baseline instruction and the alternate instruction.

* * * * *